United States Patent [19]

Wege

[11] Patent Number: 4,467,721

[45] Date of Patent: Aug. 28, 1984

[54] INK-APPLYING DEVICE

[75] Inventor: Regina Wege, Leipzig, German Democratic Rep.

[73] Assignee: VEB Kombinat Polygraph "Werner Lamberz" Leipzig, Leipzig, German Democratic Rep.

[21] Appl. No.: 443,747

[22] Filed: Nov. 22, 1982

Related U.S. Application Data

[63] Continuation-in-part of Ser. No. 249,176, Mar. 30, 1981, Pat. No. 4,392,426.

[30] Foreign Application Priority Data

Apr. 15, 1980 [DD] German Democratic Rep. ... 220444

[51] Int. Cl.[3] ..... B41F 31/06; B41F 31/08; B41F 31/26; B41L 27/28

[52] U.S. Cl. ..... 101/363; 101/365; 101/366

[58] Field of Search ..... 101/365, 363, 364, 350, 101/366, 207, 208, 209, 210, 367, 348; 118/259, 261, 267, 212

[56] References Cited

U.S. PATENT DOCUMENTS

| | | | |
|---|---|---|---|
| 512,562 | 1/1894 | Mare | 101/365 X |
| 2,762,301 | 9/1956 | Cornell | 101/365 |
| 2,887,044 | 5/1959 | Smejda | 101/207 X |
| 2,945,437 | 7/1960 | Hilgue et al. | 101/350 |
| 4,158,333 | 6/1979 | Naui | 101/363 |

FOREIGN PATENT DOCUMENTS

| | | | |
|---|---|---|---|
| 869690 | 2/1942 | France | 101/365 |

*Primary Examiner*—J. Reed Fisher
*Attorney, Agent, or Firm*—Michael J. Striker

[57] ABSTRACT

An ink-applying device includes a rotary ink-application roller and a rotary dosing roller positioned between the ink-application roller and a funnel-shaped ink reservoir filled with ink. A bottom wall of the dosing roller is formed with a longitudinal row of conical holes of differing diameters.

A number of dosing chambers of differing diameters are formed, respectively in the circumferential surface of the dosing roller to receive ink from the ink reservoir through those holes and to transmit it to an ink-application roller upon rotation of the dosing roller. A plurality of vertically movable plungers are mounted in the ink reservoir to selectively close or open the filling holes in the bottom wall communicated with respective dosing chambers in the dosing roller. A predetermined ink profile on the dosing roller may be obtained in each ink zone by selecting holes and dosing chambers to be closed and open.

6 Claims, 2 Drawing Figures

INK-APPLYING DEVICE

REFERENCE TO RELATED APPLICATION

This application is a continuation-in-part of the application Ser. No. 249,176 filed March 30, 1981, now U.S. Pat. No. 4,392,426.

BACKGROUND OF THE INVENTION

The present invention relates generally to a printing machine, and more particularly to an arrangement for applying ink to a pick-up roller in an ink-applying apparatus.

It is known that the thickness of the ink layer discharged from the ink reservoir must be adjusted so that ink to be applied is dosed to a predetermined value. In the known so-called wedge-type ink-applying arrangements the adjustment of the thickness of the ink layer is carried out by adjusting of the position of a doctor blade relative to the circumferential surface of the pick-up roller. The doctor blade in such arrangements is pressed against the pick-up roller by screw-setting devices whereby a gap between the roller and the doctor blade is changed. In such arrangements the individual color zones formed along the width of the ink reservoir in the region of the aforementioned gap are adjusted to a differing degree so that due to differing pressures on the doctor blade along the entire width of the reservoir a uniform ink profile can not be obtained.

Because the doctor blade is elastic and the neighboring color zones are differently adjusted by the screw devices and thus have a differing thickness they affect each other which also leads to the uneven ink layer along the width of the reservoir.

Devices for relatively accurate adjustment of ink layer in the ink-applying devices have been already suggested where dosing and supply of ink were controlled by pumps. Such construction is disclosed, for example in the Swiss patent No. 392,565. In the disclosed construction a plurality of pumps are mounted along the width of the ink reservoir which supply ink to respective friction rollers. It should be noted that with relatively high expenses, the satisfactory dosing of ink at individual color zones connected to respective sprinkling nozzles may be obtained. However, it should be recognized that the necessity of periodical changes and subsequent cleaning of all ink pumps, conduits and nozzles are considerably troublesome and lead to high expenses in utilization of the known devices. Furthermore, it is to be understood that in the known devices an individual drive is required for each discrete color zone and each individual nozzle outlet must be adjusted to a predetermined value in order to avoid changes in the ink profile. For these reasons, pumps, brushing devices, and centrifugal devices have not found general acceptance.

In order to overcome the problems experienced in the ink-applying arrangements it has been suggested to further improve ink dosing by changing nozzles in the ink reservoir. Such proposal is disclosed, for example, in the German patent No. 2,553,177.

The Swiss patent No. 561,119 discloses another modification of the ink-applying device where a slotted doctor blade is suggested which is formed with a plurality of neighboring portions operating independently from each other.

In the device, described for example in the U.S. Pat. Nos. 1,275,348 and 1,574,474, the doctor blade is formed of a plurality of descrete adjustable sliders. Such sliders disclosed, for example in the U.S. Pat. No. 3,978,788 are adjacently positioned along the whole width of the ink reservoir so that alltogether they form the doctor blade.

In order to change the position of the doctor blade each slider is provided with an electromotor coupled with a transmission and an eccentric device cooperated with the slider. The disadvantage of such construction is that all inaccuracies occured during the adjustment of the discrete sliders directly affect the ink layer to be dosed causing its deflection from a predetermined value. Moreover, due to the reduction of number of revolutions of electromotors required for operation of the eccentric devices a preliminary designed and calculated gap between the pick-up roller and the doctor blade should be further adjusted.

All this leads to the fact that the extremely accurate adjustment of the ink gaps in the ink-applying devices involves very high expenses since the once adjusted gap should be monitored and then readjusted again for a certain value of accuracy required in each individual case.

The U.S. Pat. No. 3,730,089 suggests to utilize a funnelshaped ink reservoir instead of the wedge-type ink containers. The ink within the reservoir is monitored by forming it into a vortex and then monitoring a radial dimension of the vortex. In such devices the doctor blade is formed by at least one of the longitudinal walls of the ink-reservoir.

SUMMARY OF THE INVENTION

It is an object of the present invention to avoid disadvantages of conventional dosing devices of ink applying mechanisms.

It is a further object of the invention to provide a dosing device which ensures a precise adjustment of the dosing device to an ink profile of a predetermined shape and value.

Still another object of the invention is to provide an ink dosing device which ensures a continuous and very sensitive adjustment of the ink clearance between the ink blade and doctor roller such that an extremely precise adjustment of the ink zones within a relatively large adjustment range is achieved by very simple means along the whole width of the ink reservoir.

Due to such precise adjustments of all individual ink zones their mutual influence in the ink zone formation can be precluded.

Owing to the fact that a remote control of the adjustment is utilized manual corrections of the ink zones are also possible.

These and other objects are attained by an ink-applying device, comprising a first ink application roller and a funnelshaped ink reservoir, and a dosing device including a dosing roller positioned between said ink application roller and said ink reservoir so as to receive ink from said ink reservoir, said dosing roller including at least one first longitudinally extending row of ink dosing chambers formed in a circumferential surface thereof, the bottom wall of the ink reservoir including a second longitudinally extending row of conical dosing holes formed in connection with an interior of the ink reservoir and above respective dosing chambers of said dosing roller; and a plurality of plungers in said ink reservoir vertically movable to selectively open respective dosing chambers and permit ink to flow thereinto or close respective dosing chamber to prevent ink from flowing thereinto A very important advantage of the invention resides in that the ink dosing is obtained from a plain end position of the movable respective plunger.

In accordance with a further feature of the invention the dosing holes in the bottom wall may be subdivided into groups of holes, each of said groups including holes of differing diameters and defining an ink zone.

The ink reservoir may include an upper wall for supporting said plungers in their vertical movement.

According to a still further feature of the invention the dosing device may include a plurality of controlling pins in the dosing roller adapted to selectively move into and from respective dosing chambers to thereby define a volume of said chambers for receiving ink therein and pull ink outward of said dosing chambers to discharge it to said ink application roller.

Furthermore, a respective individual plunger, a respective individual hole in the bottom wall, a respective dosing chamber and a respective pin may define an individual dosing unit, a number of dosing units of differing diameters being provided for each ink zone.

In accordance with yet another feature of the invention the dosing device may include means for actuating the plungers in their vertical movement; the actuating means may include a plurality of electromagnets and a plurality of levers interconnected between the electromagnets and respective plungers.

Due to the fact that a number of different holes and respective dosing chambers are arranged in each ink zone an extremely precise dosing can be achieved.

For example, three dosing chambers and three holes, respectively of various diameters can be formed in each ink zone; in this instance only the smallest dosing chamber may be used to receive ink therein whereas two remaining chambers in this zone can be closed by respective plungers. On the other hand, only an intermediate dosing chamber or only the largest one can be used or open. Independently also all possible combinations of remaining dosing chambers can be utilized. Therefore, any possible changes in ink dosing are possible because the dosing roller can rotate with various speeds, or because the dosing roller can be mounted on a maltese cross and thus so driven that it can be stopped for a while under the ink reservoir to permit respective dosing chambers to be filled with ink and then rotate further.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
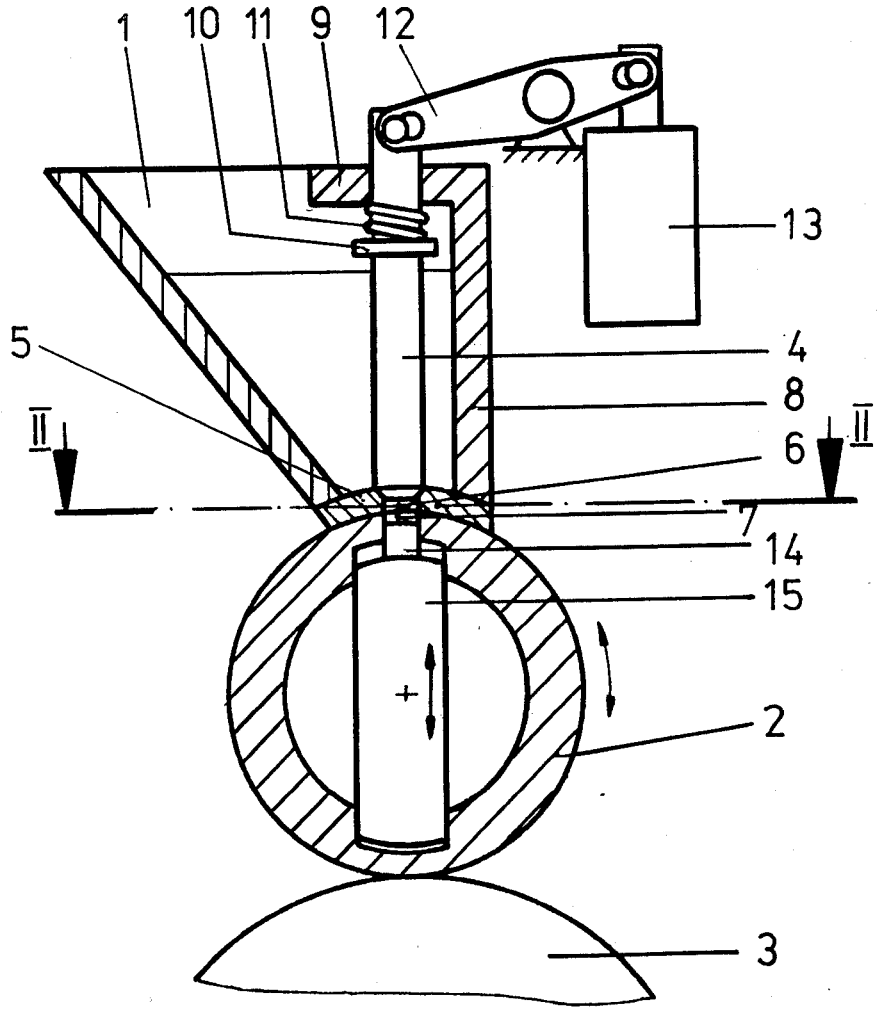
FIG. 1 is a schematic, partially sectional, view through an ink reservoir and a dosing device according to the invention.

Referring to the drawings, and first to FIG. 1, an ink applicator for a printing press includes a rotary dosing roller 2 arranged below an ink reservoir 1 filled with ink or any other suitable liquid. The dosing roller 2 is arranged in communication with a first ink-transmitting roller 3 of the ink application device, which in turn cooperates with a number of ink-application rollers in a manner known in the art and not shown herein.

The present application is a continuation-in-part of the application Ser. No. 249,176 the whole content of which is incorporated herein.

The dosing roller 2 is provided with a plurality of dosing chambers 7 of differing diameters positioned in a row extended lengthwise of the roller 2. The row of the chambers 7 is subdivided into a number of ink zones. Each ink zone includes a number of various dosing chambers.

The ink reservoir 1 includes a bottom wall 5 formed with a number of conical holes 6 having substantially differing diameters corresponding to those of the dosing chambers 7.

A plurality of plungers 4 are mounted in the ink reservoir 1 such that a respective plunger is provided for each dosing hole 6. The plungers 4 are movable between a lower and upper positions so as to open or close holes 6 and thus dosing chambers 7. When respective plungers 4 are lifted and dosing holes 6 are open ink flows into dosing chambers 7. When plungers 4 are lowered they close with their conical ends conical holes 6 and dosing chambers 7 to prevent ink from filling respective dosing chambers.

A side wall 8 of the ink reservoir 1 is formed with a substantially rectangular upper projection 9 in which respective plungers 4 are mounted and guided in their upward and downward movement. This vertical movement is affected by double-acting levers 12 and the electromagnets 13 which may be replaced by a suitable electronic control device. For example, an electrocally controlled registering strip can be used. Each plunger 4 is formed with a flange 10. A compression spring 11 is mounted on each plunger between the flange 10 and the projection 9.

Each of the dosing chambers 7 is provided with a pin 14; pins 14 of all chambers 7 are rigidly mounted on a common bar 15. This bar extends at its one side through the dosing roller 2 which is mounted in a machine wall. A pair of cam rollers may be arranged on the opposite ends of roller 2. Those rollers engage with an inner cammed surface of a respective cam such that bar 15 and pins 14 are controlled by that cam in the moving cycle of the cam rollers. Pins 14 are so operated that in the region of the bottom wall 5 they are pulled inwardly of the dosing roller 2 so that those dosing chambers 7 which are not closed by plungers 4 receive ink from reservoir 1 through holes 6. When the dosing chambers 7 reach the position in which they contact the ink-transmitting roller 3 pins 14 are moved in the outward direction to discharge ink from chambers 7 and apply it to the roller 3.

Figure 2:
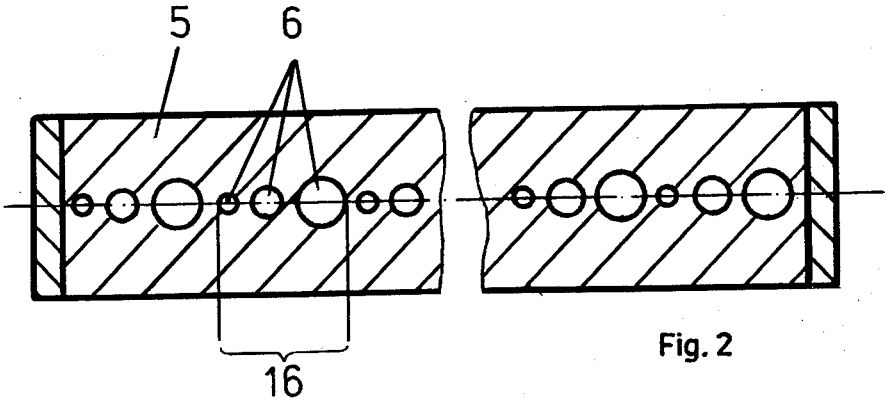
FIG. 2 is a sectional view along line II—II of FIG. 1.

As seen in FIG. 2 the bottom wall 5 and thus circumferential surface of roller 2 in the region of dosing chambers 7 form over the entire width of the roller 2 a plurality of ink zones 16; each zone including a number of holes and dosing chambers, respectively of differing diameters.

It is understood that an individual dosing unit includes a plunger 4, a dosing hole 6, a dosing chamber 7 and a corresponding pin 14. The individual dosing units within the region of one ink zone have differing diameters as shown in FIG. 2 with respect to dosing holes 6 formed in the bottom wall 5.

Ink will be discharged from the ink reservoir 1 into all dosing chambers 7 when all plungers 4 are in their lifted position. The change of the positions of plungers 4 can be affected manually or by a suitable given program; both possibilities of adjustment of the positions of plungers 4 can be, however, provided.

Owing to the fact that a number of dosing chambers and respectively dosing holes are formed within the range of each ink zone various ink volumes can be received by the dosing chambers 7 and any required ink volumes can be adjusted by selection of certain dosing holes and the dosing chambers; those volumes can be amounted from zero to any required maximum value.

As seen in FIG. 1 roller 2 is not continuously rotated but can be driven in both opposite directions as shown by arrows. Dosing roller 2 can be provided with a drive having a maltese cross and may be driven such that the dosing chambers 7 will remain for a small period of time under the dosing holes 6 to thereby ensure sufficient filling of chambers 7 with ink.

It will be understood that each of the elements described above, or two or more together, may also find a useful application in other types of ink-applying device differing from the types described above.

While the invention has been illustrated and described as embodied in ink-dosing arrangements, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an ink-applying device, comprising a first ink application roller and a funnel-shaped ink reservoir, a combination comprising a dosing device including a rotatable dosing roller positioned between said ink reservoir and said ink application roller, said ink reservoir including a bottom wall formed with a row of conical dosing holes extended longitudinally of said bottom wall and distributed over its entire length, said conical holes in said row being subdivided into groups having varying diameters and each defining an ink zone, said dosing roller including at least one row of dosing chambers formed in a circumferential surface thereof and extended lengthwise of said dosing roller and distributed over the entire length thereof, said conical dosing holes superimposing respective dosing chambers in a predetermined position of said rotatable dosing roller to fill respective dosing chambers with ink; and a plurality of plungers mounted in said ink reservoir and being vertically movable to selectively open respective dosing holes and thereby respective dosing chambers and permit ink to flow thereinto or close respective dosing holes and thus respective dosing chambers to prevent ink from flowing therein so that an adjustable ink dosing is effected over the entire length of the dosing roller.

2. The device as defined in claim 1, wherein said ink reservoir includes an upper wall for supporting said plungers in their vertical movement.

3. The device as defined in claim 2, further including a plurality of controlling pins in said dosing roller adapted to selectively move into and from respective dosing chambers to thereby define a volume of said chambers for receiving ink therein and pull ink outward of said dosing chambers to discharge it to said ink application roller.

4. The device as defined in claim 3, wherein a respective individual plunger, a respective individual hole in said bottom wall, a respective dosing chamber and a respective pin define an individual dosing unit, a number of dosing units of differing diameters being provided for each ink zone.

5. The device as defined in claim 4 further including means for actuating said plungers in said vertical movement.

6. The device as defined in claim 5, wherein said actuating means include a plurality of electromagnets and a plurality of levers interconnected between the electromagnets and respective plungers.

* * * * *